United States Patent [19]

Pullens

[11] Patent Number: 4,620,503

[45] Date of Patent: Nov. 4, 1986

[54] SHUTTER MASKING MATS

[76] Inventor: Glenn B. Pullens, 10100 Harrison Rd., Bloomington, Minn. 55437

[21] Appl. No.: 802,301

[22] Filed: Nov. 27, 1985

[51] Int. Cl.[4] ..... B05C 21/00

[52] U.S. Cl. ..... 118/505; 51/274

[58] Field of Search ..... 118/505, 504; 15/257 R; 51/274, 310

[56] References Cited

U.S. PATENT DOCUMENTS

| | | | |
|---|---|---|---|
| 624,796 | 5/1899 | Hardin | 118/505 |
| 758,372 | 4/1904 | Marsh | 51/274 |
| 804,569 | 11/1905 | Watson | 118/535 |
| 1,411,462 | 4/1922 | Wendt | 118/505 |
| 2,227,453 | 1/1941 | Koch | 118/505 |
| 3,193,408 | 7/1965 | Triller | 118/505 |
| 4,085,703 | 4/1978 | Glowacki | 118/504 |
| 4,411,219 | 10/1983 | Keith et al. | 118/505 |

*Primary Examiner*—John P. McIntosh

*Attorney, Agent, or Firm*—Palmatier & Sjoquist

[57] ABSTRACT

A pair of like adjustable masking mats for variously sized rectangular storm shutters, each including top and bottom L-shaped panels. A longitudinally oriented elongate groove is disposed on the back side of the long leg of the top panel while a complementary inwardly expanding elongate tongue is longitudinally disposed on the front side of the long leg of the bottom panel. The tongue interlocks and longitudinally slides within the groove for slidably interlocking the top and bottom panels together in a longitudinally contractable and expandable U-shape arrangement. Hand operable locking hardware is provided to releaseably hold the top and bottom panel stationary with respect to each other once the panels are sized for a particular shutter. The extending short legs of the panels each have a pair of complementary inclined engaging faces for cooperative engagement and under or overlaping of the engaging faces of the opposing adjacent mat about a shutter to permit lateral expansion and contraction of the mats with respect to each other to thereby adjustably mask variously sized shutters. The inner margins of the panels slope downwardly from intermediate the front side to the innermost edge of the respective panels to facilitate their fitting about and behind a shutter.

8 Claims, 12 Drawing Figures

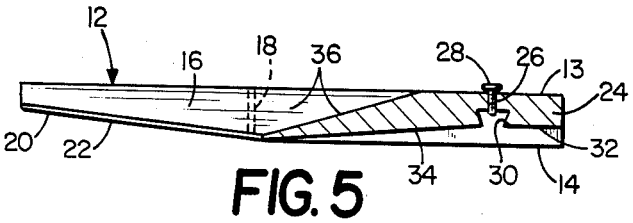
FIG. 5
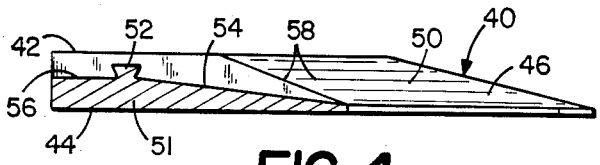
FIG. 4
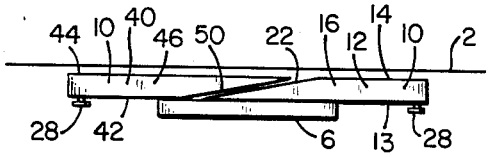
FIG. 10
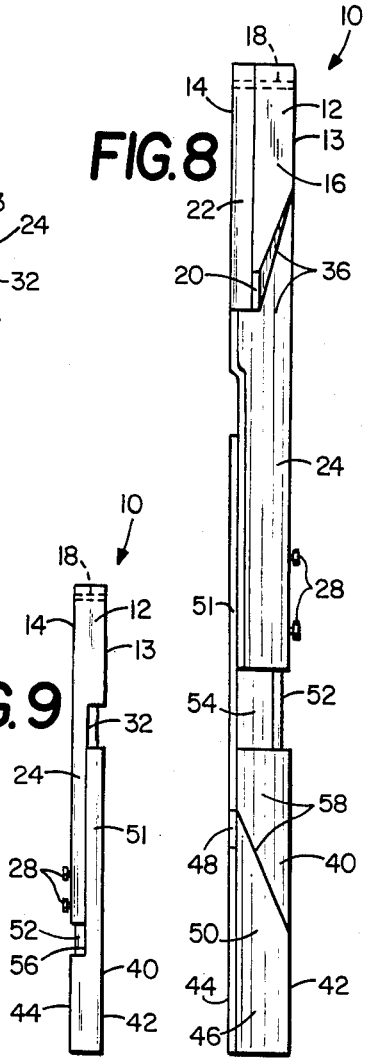
FIG. 8
FIG. 9
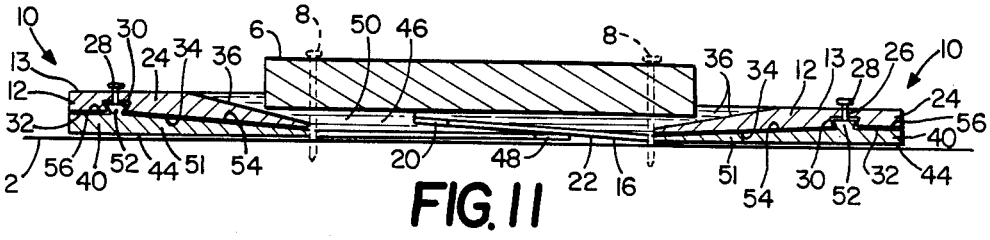
FIG. 11
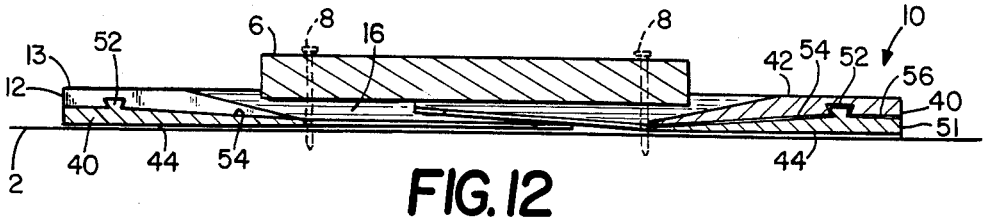
FIG. 12

SHUTTER MASKING MATS

FIELD OF THE INVENTION

This invention relates to adjustable masking mats for protecting and preventing the soiling or marking of a wall or window when cleaning, finishing, refinishing or painting variously sized rectangular storm shutters without detachment of the shutters from the wall.

Historically, storm shutters were pivotally connected adjacent the vertical sides of windows and doors of buildings and houses. With only a short notice of an impending violent storm, the dweller needed only to unlatch the opened shutters from the exterior wall or siding and swing them closed over the window or door and latch them securely. Thereafter, the windows would be protected from damage or breakage from the elements and flying debris.

Storm shutters also add ornamentation and character to a building. They are often painted a different color compared with the exterior wall or siding of a building to add contrasting beauty. Storm shutters have maintained a highly distinctive appeal in today's architecture. However, most storm shutters today have lost their original functionality. Typically they are fastened securely to the exterior wall or siding adjacent the vertical sides of windows. They no longer pivot or swing to close over windows.

Shutters characteristically have been and are still, commonly made of wood and require initial and frequent refinishing to maintain their aesthetic appeal and to prevent rotting. The chore of cleaning, refinishing and painting shutters is somewhat difficult in that windows and their respective shutters, whether securely affixed or pivotally mounted, are generally located in hard to reach places on the exterior of a building.

Ordinarily, the shutters are detached by hardware disconnection from the exterior wall or siding, often with the aid of a ladder, and carried down to ground level for individual treatment. By this method, the soiling or marking of the exterior wall or siding would be adequately prevented. However, wood shutters are often large, bulky and heavy thereby requiring a concern for, and exercise of, extreme personal safety measures when detaching, lowering, raising and attaching shutters while on a ladder above the second or third stories of a building.

SUMMARY OF INVENTION

A pair of like adjustable shutter masking mats for variously sized rectangular storm shutters, each including top and bottom L-shaped panels. A longitudinally oriented elongate groove is disposed on the back side of the long leg of the top panel while a complementary inwardly expanding elongate tongue is longitudinally disposed on the front side of the long leg of the bottom panel. The tongue interlocks and longitudinally slides within the groove for slidably interlocking the top and bottom panels together in a longitudinally contractable and expandable U-shape arrangement. Hand operable locking hardware is provided to releaseably hold the top and bottom panel stationary with respect to each other once the panels are sized for a particular shutter. The extending short legs of the panels each have a pair of complementary inclined engaging faces for cooperative engagement and under or overlapping of the engaging faces of the opposing adjacent mat about a shutter to permit lateral expansion and contraction of the mats with respect to each other to thereby adjustably mask variously sized shutters. The inner margins of the panels slope downwardly from intermediate the front side to the innermost edge of the respective panels to facilitate their fitting about and behind a shutter.

In operation, the fastening hardware or screws of a particular shutter to be masked are loosened or backed outwardly to create a gap between the shutter and the exterior wall or siding. Thereafter, the inner margins of a first mat are slid behind the top portions of the shutter. The bottom panel is longitudinally adjusted to permit the inner margins of the lower panel to fit snugly behind the side and bottom portions of the shutter. A second adjustable masking mat is oriented upside-down or 180° with respect to the first mat and is similarly positioned behind the other side of the shutter with opposing engaging faces adjustably under or overlapping each other. Once the mats are longitudinally and laterally adjusted in place, the shutter may be treated without soiling or marking the window and exterior wall or siding.

The invention advantageously provides an adjustable masking mat for protecting and preventing the soiling or marking of a wall or window when cleaning, finishing, refinishing or painting variously sized rectangular storm shutters without the need for dangerous and time consuming detachment of the shutters from the exterior wall. The mats are both longitudinally and laterally adjustable to accommodate various sizes of shutters as well as those that are not perfectly square.

BRIEF DESCRIPTION OF THE DRAWINGS

FIG. 4 is a cross sectional view taken along lines 4—4 of FIG. 2;

FIG. 5 is a cross sectional view taken along lines 5—5 of FIG. 2;

FIG. 8 is a side elevational view taken along lines 8—8 of FIG. 6;

FIG. 9 is a side elevational view taken along lines 9—9 of FIG. 7;

FIG. 10 is a top view taken along lines 10—10 of FIG. 1;

FIG. 11 is a cross sectional view taken along lines 11—11 of FIG. 1; and FIG. 12 is a cross sectional view taken along lines 12—12 of FIG. 1.

DETAILED SPECIFICATION

Figures 1, 2, 3, 6, 7:
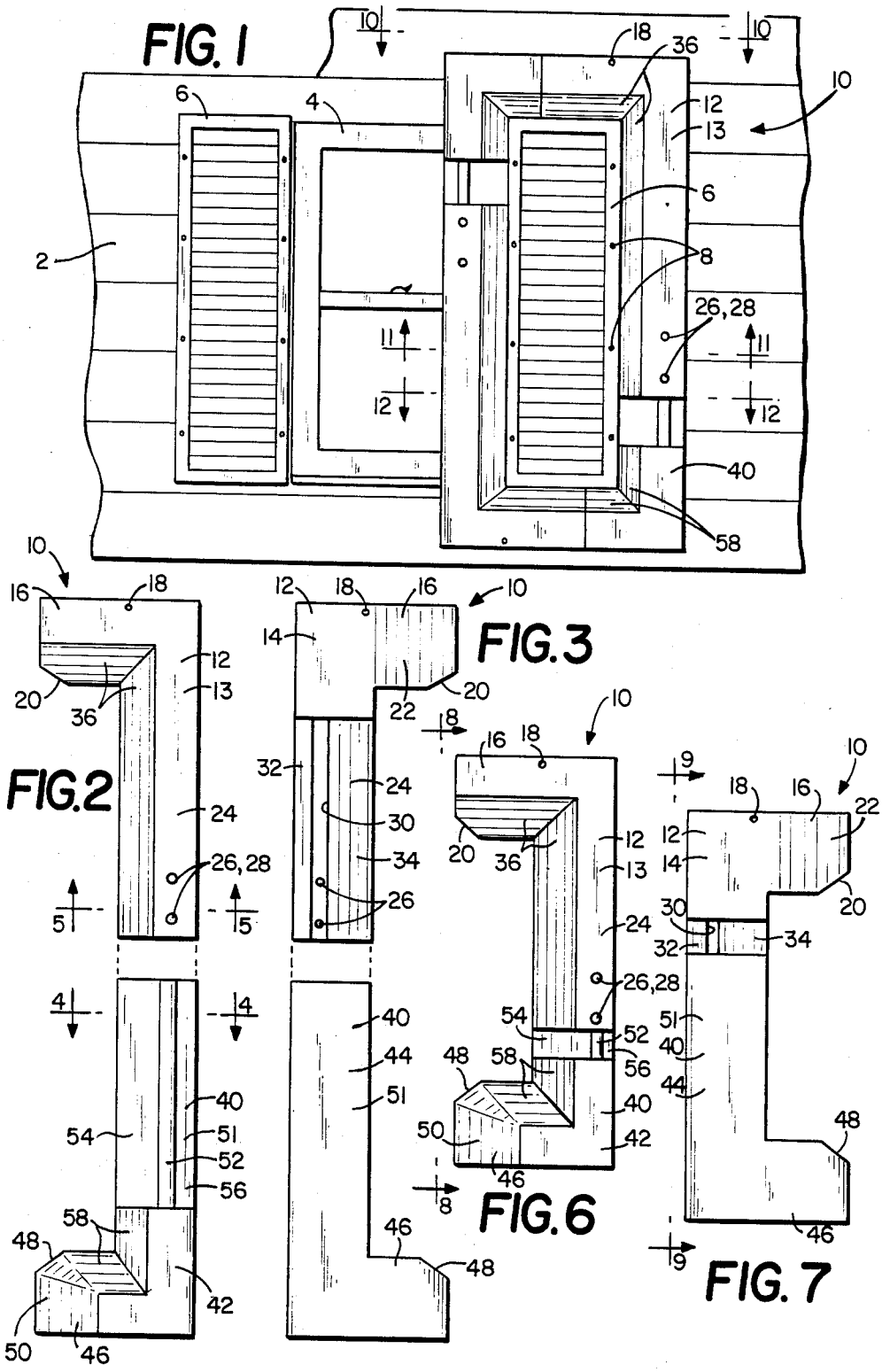
FIG. 1 is a front elevational view of the adjustable storm shutter masking mats of the invention connected about a shutter.
FIG. 2 is a front elevational view of the top and bottom panels of one of the masking mats.
FIG. 3 is a rear elevational view of the top and bottom panels of FIG. 2.
FIG. 6 is a front elevational view of the adjustable shutter masking mat.
FIG. 7 is a rear elevational view of the mat of FIG. 6.

As shown in FIG. 1, a building characteristically has an exterior wall or siding 2 with windows 4 therein. Shutters 6 may be pivotally or permanently connected to siding 2 adjacent the vertical sides of window 4. Two like adjustable storm shutter mats 10, one oriented 180° and opposing the other in a similar plane, are shown about and behind shutter 6 to protect and prevent the soiling or marking of siding 2 and window 4. Shutter mats 10 are generally U-shaped and each include a top L-shaped panel 12 and a bottom L-shaped panel 40 slidably interconnected. Mats 10 suitably may be molded of a lightweight plastic or the like.

Referring to FIGS. 2, 3, 4 and 5, the details of top L-shaped panel 12 and bottom L-shape panel 40 of one of the like pair shutter mats 10 may more clearly be seen. Top L-shaped panel 12 has a front side 13 and back side 14. Top panel 12 also includes short leg 16 and long leg 24. Short leg 16 preferably has a hanger hole 18 for a string to pass therethrough to facilitate the raising, lowering or storing shutter masking mat 10. Short leg 16 also has a cut corner 20 and an inclined engaging face 22 on its back side 14 (FIG. 3). Engaging face 22 slopes upwardly (FIG. 5) from generally intermediate to the outermost edge (adjacent corner 20) of the back side 14 of short leg 12 as shown. Long leg 24 preferably has threaded apertures 26 therethrough. Cooperative hand operable hardware, such as large headed screws 28, are turnably adjustable along the axes of apertures 26. On the back side 14 of long leg 24, an inwardly expanding elongate groove 30 is longitudinally disposed therein. Adjacent groove 30 is recessed flat outer face 32 and downwardly sloping inner face 34. Apertures 26 are aligned with elongate groove 30.

Bottom L-shaped panel 40 has a front side 42 and a back side 44. Bottom panel 40 also includes short leg 46 and long leg 51. Short leg 46 has a cut corner 48 and an inclined engaging face 50 on its front side 42 (FIG. 2). Engaging face 50 slopes downwardly from generally intermediate to the outermost edge (adjacent corner 48) of the front side 42 of short leg 46 as shown. Long leg 51 has outwardly expanding elongate tongue 52 which is longitudinally disposed on front side 42 and is constructed to slidably interlock with elongate groove 30 in top panel 12. Adjacent tongue 52 is downwardly sloping inner shoulder 54, which slidably engages downwardly sloping inner face 34 of top panel 12, and recessed flat outer shoulder 56, which slidably engages flat outer face 32 of top panel 12.

By this arrangement, top L-shaped panel 12 and bottom L-shaped panel 40 may be slidably interconnected and will longitudinally expand and contract with respect to each to accommodate various shutters 6 having different vertical dimensions. Once panels 12 and 40 are properly sized, hand turntable screws 28 in apertures 26 may be turned inwardly to frictionally bear upon tongue 52 to effectively hold panels 12 and 40 stationary with respect to each other.

The front side 13 of top panel 12 appropriately has a downwardly sloping inner margin 36 which begins intermediate panel 12 sloping downwardly towards the inner edge of the L-shaped panel 12 as shown. Bottom panel 40 also includes a downwardly sloping inner margin 58 similar to inner margin 36 of top panel 12. Both inner margins 36 and 58 facilitate sliding mat 10 between siding 2 and loosened shutter 6.

Referring to FIGS. 6, 7, 8 and 9, the adjustable interconnecting arrangement of top L-shaped panel 12 and bottom L-shaped panel 40 may be seen. Panels 12 and 40 interconnect forming a generally U-shaped adjustable storm shutter masking mat 10.

Referring to FIGS. 1, 10, 11 and 12, the operation and fit of a like pair of adjustable storm shutter masking mats 10 may be seen. Initially, screws 8 which hold shutter 6 to house siding 2 are turned outwardly to create a space between shutter 6 and siding 2 without complete detachment of shutter 6. Thereafter, one mat 10 may be hoisted up the latter by a string secured in hanger hole 18 if the user is above the first floor of the particular building.

Mat adjustment screws 28 are loosened to adjustably expand or contract mat 10. The inner opposing margins 36 and 58 of short legs 16 and 46 are then sized apart so as to permit the inner opposing margin 36 of shortleg 16 to be guided behind shutter 6 while the inner opposing margin 58 of shortleg 46 extends slightly beyond the bottom edge of shutter 6. The inner margin 36 of top panel 12 is inserted between siding 2 and shutter 6 until it either strikes shutter screws 8 or until its unique sloping wedge design permits it to become wedged therebetween. Bottom panel 40 is then lifted upwardly so that the inner margin 58 of short leg 46 is also directed behind shutter 6 until either striking shutter screws or until its unique sloping wedge design becomes wedged between shutter 6 and siding 2. Thereafter, mat adjustment screws 28 are hand tightened to secure mat 10 thereat.

A second like adjustable storm shutter masking mat 10 is similarly hoisted up the latter and is turned upside-down or oriented 180° with respect to the first masking mat 10. Mat adjustment screws 28 are then turned outwardly to permit longitudinal adjustment of mat 10 which is then similarly sized about and behind shutter 6 as was first mat 10.

The unique inclined engaging faces 22 and 50 of the opposing mats 10 are complementary with respect to each other when oriented as such. This arrangement permits outer and under lapping of engaging faces 22 and 50 to thereby permit lateral adjustment of mats 10 about shutters 6 of varying widths. Corners 20 and 48 are cut as such to facilitate in the initial sliding engagement of faces 22 and 50. Second like mat 10 is simply moved inwardly until opposing and confronting inclined engaging faces 22 and 50 become wedged tight between shutter 6 and siding 10, or until second mat 10 strikes shutter screws 8. This arrangement further assures that like mats 10 will remain behind shutter 6 until they are removed.

Shutter 6 may then be cleaned, finished, refinished or painted while masking mats 10 protect and prevent soiling or marking of the house siding 2 and window 4. After treatment, the pair of shutter masking mats 10 may be removed from between shutter 6 and house siding 2 in reverse order of their application. Should mats 10 become wedged too tightly behind shutter 6, shutter screws 8 may be loosened or backed out a little to release mats 10.

The present invention may be embodied in other specific forms without departing from the spirit or essential attributes thereof. That is, complementary components of panels 12 and 40 may simply be reversed or disposed on the other panel provided the complementary arrangement is still present. Therefore, the illustrated embodiment should be considered in all respects as illustrative and not restrictive, reference being made to the appended claims rather than to the foregoing description to indicate the scope of the invention.

That which is claimed is:

1. A longitudinally adjustable masking mat for protecting and preventing the soiling or marking of an exterior wall or window when cleaning, finishing, refinishing or painting variously sized rectangular storm shutters without detachment of the masked shutter from the wall, comprising:

(a) a top L-shaped panel with a front side, a back side, a short leg, a long leg and an inclined engaging face on the back side of the short leg;

(b) a bottom L-shaped panel with a front side, a back side, a short leg, a long leg and an opposing inclined engaging face on the front side of the short leg of the bottom panel;

(c) an adjustable interlocking means longitudinally disposed on the back side of the long leg of the top panel and on the front side of the long leg of the bottom panel for slidably interlocking the top and bottom panels together in a longitudinally expandable and contractable U-shape arrangement to thereby adjustably mask variously sized shutters.

2. The adjustable masking mat of claim 1 wherein the interlocking means comprises an inwardly expanding elongate groove and an outwardly expanding complementary elongate tongue which is adapted to interlock and longitudinally slide within the groove.

3. The adjustable masking mat of claim 1 further comprises an inner margin on the top and bottom panels which slopes downwardly from intermediate the front side to the innermost edge of the respective panels.

4. The adjustable masking mat of claim 1, in combination with a second like longitudinally adjustable masking mat to be oriented approximately 180° with respect to the first expandable masking mat in a similar plane so that the opposing inclined engaging faces of the like opposing mats cooperatively engage and overlap each other to permit lateral expansion and contraction of the mats with respect to each other to thereby completely adjustably mask variously sized shutters.

5. The adjustable masking mat of claim 1 wherein the inclined engaging face on the back side of the top panel slopes upwardly from intermediate to the outermost edge of the back side of the short leg while the inclined engaging face on the front side of bottom panel slopes downwardly from intermediate to the outermost edge of the front side of the short leg.

6. The adjustable masking mat of claim 1, further comprising hand operable locking means to releaseably hold the top and bottom panels stationary with respect to each other.

7. The adjustable masking mat of claim 6, wherein the hand operable locking means comprises a threaded aperture through one of the long legs adjacent the interlocking means and a hand operable threaded screw adjustably movable within the aperture to frictionally bear upon the other long leg and thereby releasably prevent longitudinal expansion and contraction of the top and bottom panels.

8. A pair of like laterally and longitudinally adjustable masking mats for protecting and preventing the soiling or marking of an exterior wall or window when cleaning, finishing, refinishing or painting variously sized rectangular storm shutters without detachment of the masked shutter from the wall, each comprising:

(a) a top L-shaped panel with a front side, a back side, a short leg, a long leg, an inner margin which slopes downwardly from intermediate the front side to the innermost edge of the panel and an inclined engaging face on the back side of the short leg which slopes upwardly from intermediate to the outermost edge of the back side of the short leg;

(b) a bottom L-shaped panel with a front side, a back side, a short leg, a long leg, an inner margin which slopes downwardly from intermediate the front side to the innermost edges of the panel and an inclined engaging face on the front side of the short leg which slopes downwardly from generally intermediate to the outermost edge of the front side of the short leg, the inclined engaging faces of one mat being adapted to cooperatively engage and lap the inclined engaging faces of the other mat of the pair when opposing each other to permit lateral expansion and contraction of the masking mats with respect to each other;

(c) an inwardly expanding elongate groove and an outwardly expanding complementary elongate tongue, one of which being longitudinally disposed on the back side of the long leg of the top panel an the other of which being longitudinally disposed on the front side of the long leg of the bottom panel, the tongue being adapted to interlock and longitudinally slide within the groove for slidably interlocking the top and bottom panels together in a U-shaped arrangement to permit longitudinal expansion and contraction of panels with respect to each other to thereby completely adjustably mask various sized shutters; and (d) hand operable locking hardware to releaseably hold the top and bottom panels stationary with respect to each other.

* * * * *